US005093651A

United States Patent [19]

Thomas

[11] Patent Number: 5,093,651

[45] Date of Patent: Mar. 3, 1992

[54] INTELLIGENT SMOKE DETECTOR

[76] Inventor: Edward M. Thomas, 1040 Carroll St., #6B, Brooklyn, N.Y. 11225

[21] Appl. No.: 595,860

[22] Filed: Oct. 11, 1990

[51] Int. Cl.[5] ..... G08B 17/10

[52] U.S. Cl. ..... 340/628; 340/527; 368/10

[58] Field of Search ..... 340/628, 629, 630, 527, 340/528, 430; 368/10

[56] References Cited

U.S. PATENT DOCUMENTS 4,600,314 7/1986 Theriault ..... 340/628 X
4,788,530 11/1988 Bernier ..... 340/628 X
4,792,797 12/1988 Targuay et al. ..... 340/628
4,922,227 5/1990 Hesterman ..... 340/527

*Primary Examiner*—Jin F. Ng
*Assistant Examiner*—Jeffery A. Hofsass

[57] ABSTRACT

A smoke detector has an alarm which may be turned off for a short interval to prevent its sounding continuously upon actuation by nonthreatening smoke or a malfunction. A timing circuit having a switch is connected between the smoke detector battery and the smoke detector, and actuating the switch will deactivate the smoke detector for a short period. If the alarm sounds after the smoke detector is automatically reconnected to the battery, the switch may be reactuated.

8 Claims, 1 Drawing Sheet

INTELLIGENT SMOKE DETECTOR

BACKGROUND OF THE INVENTION

1. Field of the Invention

This invention relates to an electronic timing circuit adapted to be connected between a smoke detector and its battery power supply and including a manually operable switch actuable to turn off the smoke detector for a short period when the smoke detector has triggered its alarm.

2. Description of the Prior Art

Smoke detectors are in common use in many households today. Inexpensive smoke detector which may be installed easily by the average person are commercially available. Most such smoke detectors are powered by a single 9 volt battery which is easily replaceable.

While such smoke detectors are invaluable in providing an early warning in case of fire, their sensitivity to small amounts of smoke and/or heat often causes the alarm, usually an audible signal, to be triggered by a small amount of smoke. For example, a person smoking near the detector, or the burning of toast, will both commonly cause the alarm to be sounded. The alarm will remain operative until the smoke is dissipated. Since many times the reason for sounding the alarm is not threatening, it is desirable that the annoyance of the alarm, often a harsh, piercing sound, be eliminated for the time that the alarm sounds.

Unfortunately with most smoke detectors and alarms there is no convenient way to turn them off for a brief period. Sometimes a person will disconnect the battery to eliminate the annoyance of the alarm with a real risk that the battery may not be replaced after the smoke is gone. Sometimes the smoke detector is simply disconnected, again with the risk of forgetting to reconnect it later. A simple and inexpensive device for allowing temporary disconnection of a smoke detector during false alarms and which will automatically reconnect the smoke detector is very desirable.

The present invention is an electronic timing circuit easily connected between the battery and the detection circuitry of a smoke detector. The timing circuit includes a switch which permits a person to temporarily disconnect the alarm of the smoke detector when a false alarm or malfunction occurs. Simply pressing the switch will temporarily eliminate the annoying sound of the alarm. After a preselected time delay, determined by the circuitry, the smoke detector and its alarm are reconnected automatically, eliminating the detector is reconnected, if the alarm still sounds the switch is pressed again to repeat the process.

The prior art does not provide a simple and inexpensive circuit of the type disclosed. In U.S. Pat. No. 4,404,550 to Shaw there is shown a portable smoke detector adapted to be used in luggage by travelers. The device has a switch connecting the smoke detector with its battery power supply. U.S. Pat. No. 4,525,703 to Bellino describes a portable smoke detector with a separate alarm, and an elongated electrical lead connecting the alarm to the smoke detector which, when connected, completes the circuit and permits the device to operate, and when not connected provides a conspicuous reminder that the circuit is disconnected. U.S. Pat. No. 4,567,477 to Cormier relates to a smoke detector having an alarm with an on-off switch permitting the alarm to be turned off for false alarm situations with a visually apparent indicator that the device is inoperative.

An object of the present invention is a smoke detector having an alarm which may be turned off for a short interval when the alarm sounds.

A further object of this invention is a smoke detector having an alarm which may be turned off when a false alarm sounds, but which is automatically reactivated after a short time.

Another object of this invention is a timing circuit adapted to be connected between the battery and a smoke detector, and including a switch for temporarily disconnecting the smoke detector.

A still further object of this invention is an inexpensive circuit adapted to be attached easily to a smoke detector which may be actuated to turn off the detector and its alarm for a brief period.

SUMMARY OF THE INVENTION

In accordance with this invention, a timing circuit is adapted to be interposed between the battery and the detector portion of a smoke detector. A switch in the circuit is actuable manually to disconnect the battery from the detector and render the detector inoperative for a short time. The battery is then automatically reconnected to the detector, and the switch may be actuated again.

DESCRIPTION OF THE PREFERRED EMBODIMENT

Figure 1:
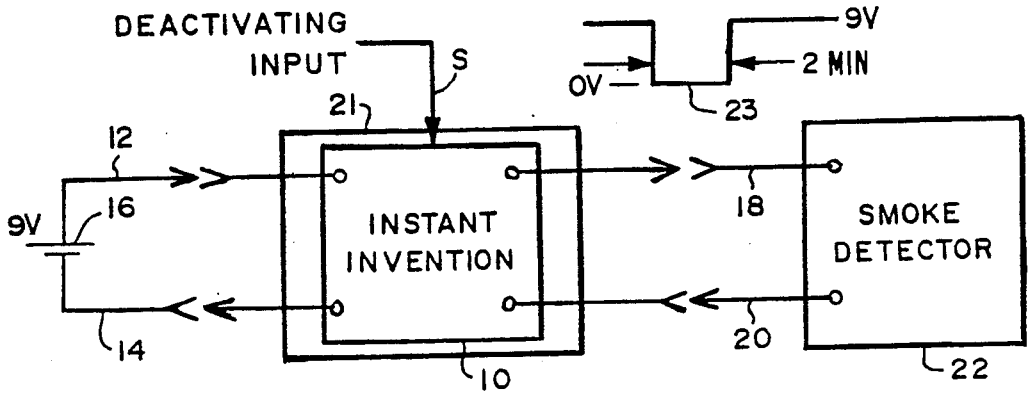
FIG. 1 is a block diagram of the invention installed in a typical smoke detector.

Referring to FIG. 1, the timing circuit 10 of this invention is connected via electrical lines 12 and 14 to the positive and negative terminals respectively of a power supply illustrated as a 9 volt battery 16. Circuit 10 is also connected via lines 18 and 20 to a standard commercially available smoke detector 22. The detector 22 typically contains an audible alarm which is actuated when the detector senses the presence of smoke and/or heat. The connection may be made in any convenient manner, typically by removing the battery and cutting the wires extending from the battery terminals to the detector, and connecting the circuit 10 between the wires taking care to maintain the correct polarities. The circuit 10 may be contained on a small printed circuit board, and takes little room, so that it may easily be inserted within the casing of the smoke detector. A switch shown as S in FIG. 1 actuates the circuit 10 and may be inserted through a small opening made in the detector casing, shown schematically at 21.

Shown by reference numeral 23 is a graph of the voltage transmitted to the detector 22 via lines 18 and 20 when switch S is actuated. The voltage drops from +9 volts to 0 volts, remains at 0 volts for 2 minutes, then returns to +9 volts. During the 2 minutes when the voltage available to the detector 22 is 0 volts, the detector 22 is inactivated and cannot sound its alarm.

Figure 2:
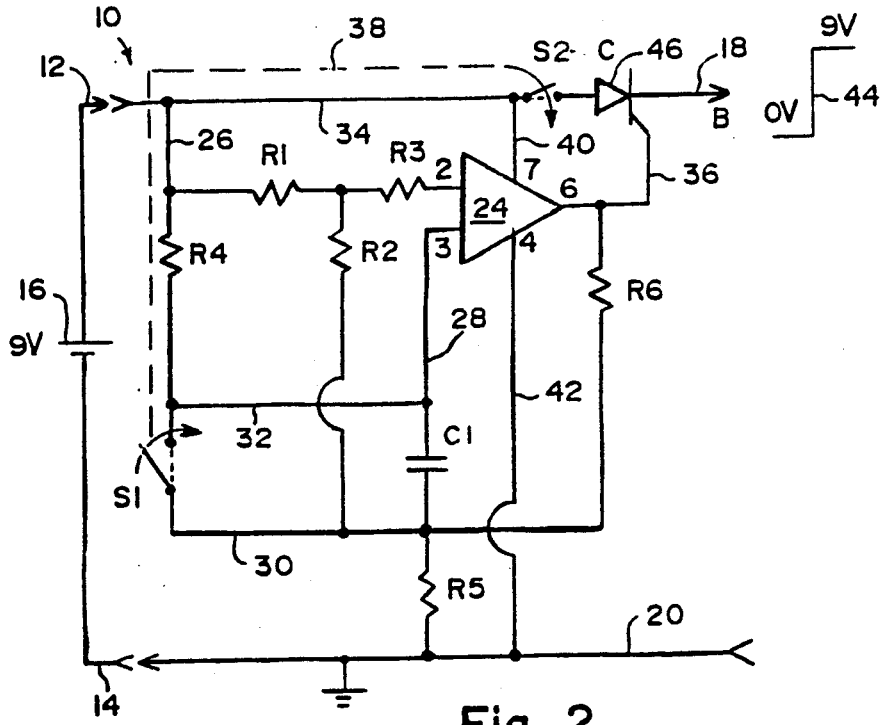
FIG. 2 is a schematic drawing of the circuitry of the invention.

FIG. 2 shows the components of the timing circuit 10. An amplifier 24, preferably a standard operational amplifier, has an inverting input at terminal 2 supplied from the positive terminal of battery 16 through line 12, line 26, resistor R1 and resistor R3. Connected to non-inverting terminal 3 of amplifier 24 through line 28 is a capacitor C1. The other side of capacitor C1 is connected through line 30, switch S1 and resistor R4 to line 26. Switch S1 is normally open. A line 32 connects resistor R4 to capacitor C1. A resistor R2 connects the junction between resistors R1 and R3 to line 30. A resistor R5 is connected between line 30 and the grounded negative terminal of battery 16 through line 14.

The positive battery terminal is connected via line 12, line 34, switch S2 and a silicon controlled rectifier 46 (commonly referred to by the acronynm SCR) to line 18. The output from amplifier 24 on terminal 6 is connected via line 36 to gate the SCR. The terminal 6 is also connected via resistor R6 to line 30. Switch S2 is normally closed. Switches S1 and S2 are ganged together as shown by dashed lines 38, and are of the type which, when actuated by being moved from their normal position, will return to their normal position when released. An actuator for the switches S1 and S2 such as a spring biase switch or button shown at S in FIG. 1 may be inserted in a small opening made in the casing 21 of the smoke detector so that both switches S1 and S2 will be actuated when the deactivating input button S is pressed. Thus when switch S is actuated, switch S2 will open and switch S1 will close. Upon release of the switch button illustrated at S, switch S1 will reopen and switch S2 will close.

Also in FIG. 2, positive voltage from battery 16 is supplied to terminal 7 of amplifier 24 via line 40, and terminal 4 of amplifier 24 is connected to the negative si battery 16 via line 42.

In operation, amplifier 24 is normally conducting and the voltage on terminal 6 is high, about +9 volts if the negative terminal of battery 16 is at ground. The SCR is gated on and the voltage from battery 16 is available to smoke detector 22 through line 34 and the low impedance of the gated SCR. C1 is fully charged through the path including R4 and R5 and maintains terminal 3 of amplifier 24 at a high positive voltage. Terminal 2 is at a lower voltage than terminal 3 as a result of the voltage drop across R1 in path R1, R2 and R5.

Upon pressing switch S, switch S1 will close and switch S2 will open. C1 will discharge through S1 and the voltage at terminal 3 will drop. When S2 opens, the battery 16 will be disconnected from the detector 22 and the smoke detector 22 will become inoperative. Amplifier 24 will become nonconducting and the gate signal on line 36 will be removed.

Upon release of switch S, S1 will open and C1 will immediately begin charging. Depending on the RC time constant, which can be set to a convenient time such as 2 minutes, when C1 is fully charged amplifier 24 will conduct, line 36 will rise and SCR will be gated on. Switch S2 closes when S1 reopens and the positive battery voltage appears at the input to SCR, but SCr will not conduct until the gate voltage is supplied on line 36 which occurs when amplifier 24 is turned on. Reference numeral 44 shows how the signal on line 18 rises from 0 volts to +9 volts when SCR becomes conducting.

The time constant of the RC circuit containing C1 may be varied by adjusting the resistance values of resistors R4 or R5 or the capacitance of C1. The use of adjustable resistor and/or capacitor to change the time of the response of the circuit is within the scope of this invention.

While the invention has been described with reference to the preferred embodiment thereof, it is apparent that changes may be made to the components and their arrangement without departing from the scope of the invention as hereinafter claimed.

What is claimed is:

1. A smoke detector apparatus comprising:

a) a source of power;

b) smoke detector means connected with said power source and actuable in response to the presence of smoke in the vicinity of said apparatus;

c) audible alarm means connected with said smoke detector means and operable in response to actuation of said smoke detector means;

d) timing circuit means including switch means having first and second position located between said power source to said smoke detector means for connecting said power source to said smoke detector means when said switch means is in said first position, and for disconnecting sad power source from said smoke detector means for a predetermined period when said switch means is moved to said second position;

e) charging means connected to actuate amplifier means and having a time delay actuable upon movement of said switch means to said second position, and then moved back to the first position; and f) a direct circuit path containing controlled rectifier means connected between said power source and said smoke detector means, and further including said amplifier means connected to said controlled rectifier means and supplying a gating signal thereto when said gating signal on the inverting input means to the said amplifier means has increased by said charging means to the signal level of the noninverting input means of the said amplifier means, and said switch means is in said first position, causing the said amplifier and said controlled rectifier means to become conductive, whereby said source of power is connected to said detector means.

g) said switch means further comprising:

a) a first switch means (S1), connected in parallel with said charging means, said first switch being normally open;

b) a second switch (S2), connected in the direct circuit path between sad power source and said smoke detector means, said switch being normally closed, and c) manual actuator means connecting said first and second switches, actuation of said manual actuator means temporarily moving said first and second switches from their normal positions disconnecting said power source from said smoke detector and causing said charging means to discharge whereby said amplifier means is rendered nonconductive and said gating signal is terminated, said first and second switches returning to their normal positions upon termination of the actuation of said manual actuator means.

2. A smoke detector apparatus as in claim 1, in which said amplifier means is an operational amplifier.

3. A smoke detector apparatus as in claim 1 in which said charging means is a capacitor.

4. A smoke detector apparatus as in claim 1, in which said controlled rectifier means is a silicon controlled rectifier.

5. A smoke detector apparatus as in claim 1, including means to change the time constant of said charging means.

6. A smoke detector apparatus as in any of claims 1–5, which is inexpensive and may be installed by the average person.

7. A smoke detector apparatus as in claim 6 which is easily relocatable.

8. A smoke detector apparatus as in any of claims 1–5, which is full self contained within a single housing means.

* * * * *